US012558585B2

(12) United States Patent
Lafrance et al.

(10) Patent No.: US 12,558,585 B2
(45) Date of Patent: Feb. 24, 2026

(54) RACKING AND UNRACKING EXERCISE MACHINE

(71) Applicant: Tonal Systems, Inc., San Francisco, CA (US)

(72) Inventors: Ryan Lafrance, San Francisco, CA (US); Aly E. Orady, San Francisco, CA (US); Brandt Belson, San Francisco, CA (US); Sarah Wilson Lewis, San Francisco, CA (US)

(73) Assignee: Tonal Systems, Inc., San Francisco, CA (US)

( * ) Notice: Subject to any disclaimer, the term of this patent is extended or adjusted under 35 U.S.C. 154(b) by 264 days.

(21) Appl. No.: 18/368,973

(22) Filed: Sep. 15, 2023

(65) Prior Publication Data

US 2024/0149094 A1 May 9, 2024

Related U.S. Application Data

(63) Continuation of application No. 17/856,423, filed on Jul. 1, 2022, now Pat. No. 11,794,056, which is a (Continued)

(51) Int. Cl.
*A63B 21/005* (2006.01)
*A63B 21/00* (2006.01)
(Continued)

(52) U.S. Cl.
CPC .... *A63B 21/0058* (2013.01); *A63B 21/00069* (2013.01); *A63B 21/151* (2013.01); (Continued)

(58) Field of Classification Search
CPC ..... A63B 21/0058; A63B 21/151; A63B 21/00069; A63B 23/035; A63B 24/0087; A63B 24/0062; A63B 2230/06; A63B 2220/801; A63B 2220/833; A63B 2220/10; A63B 2220/36; A63B 21/153; A63B 21/4043; A63B 2071/0072; A63B 2071/068; A63B 2071/0677; A63B 2220/40; A63B 2225/50; A63B 2225/20; A63B 2225/15; A63B 2071/0081; A63B 2071/063; A63B 2071/0627; (Continued)

(56) References Cited

U.S. PATENT DOCUMENTS 4,323,237 A * 4/1982 Jungerwirth ..... A63B 21/157 73/379.06
4,647,038 A 3/1987 Noffsinger
(Continued)

FOREIGN PATENT DOCUMENTS

EP 3202465 8/2017
WO 2017133823 8/2017

*Primary Examiner* — Andrew S Lo
(74) *Attorney, Agent, or Firm* — Van Pelt, Yi & James LLP

(57) ABSTRACT

An indication is received from a user to rack or unrack a digital weight. A motor is signaled to apply or remove tension to a cable couple to the motor based at least in part on the indication. The actuator is connected to the cable and is physically arranged to deliver a force to the user. The motor selectively tensions a cable in accordance with an exercise program.

20 Claims, 7 Drawing Sheets

Related U.S. Application Data continuation of application No. 17/178,154, filed on Feb. 17, 2021, now Pat. No. 11,406,861, which is a continuation of application No. 16/538,713, filed on Aug. 12, 2019, now Pat. No. 11,426,618.

(60) Provisional application No. 62/718,886, filed on Aug. 14, 2018.

(51) Int. Cl.
*A63B 23/035* (2006.01)
*A63B 24/00* (2006.01)

(52) U.S. Cl.
CPC ..... *A63B 23/035* (2013.01); *A63B 24/0062* (2013.01); *A63B 24/0087* (2013.01); *A63B 2220/801* (2013.01); *A63B 2220/833* (2013.01); *A63B 2230/06* (2013.01)

(58) Field of Classification Search
CPC ..... A63B 2220/805; A63B 2220/16; A63B 2024/0093; A63B 71/0054
See application file for complete search history.

(56) References Cited

U.S. PATENT DOCUMENTS 4,772,015 A * 9/1988 Carlson ..... A63B 21/4047 482/902
5,271,416 A * 12/1993 Lepley ..... A61B 5/1036 600/595
5,910,070 A 6/1999 Henry
6,028,593 A * 2/2000 Rosenberg ..... B25J 9/1689 463/37
6,210,348 B1 * 4/2001 Reed ..... A61H 1/0292 601/23
6,280,361 B1 * 8/2001 Harvey ..... A63B 24/00 482/4
6,902,513 B1 * 6/2005 McClure ..... A63B 24/0006 482/4
6,997,852 B2 * 2/2006 Watterson ..... H04L 67/04 482/8
7,278,958 B2 * 10/2007 Morgan ..... A63B 21/00065 482/99
7,967,728 B2 * 6/2011 Zavadsky ..... A63F 13/28 482/901
8,727,946 B2 * 5/2014 Greenhill ..... A63B 21/0626 482/9
8,852,062 B2 * 10/2014 Dorsay ..... A63B 23/12 482/121
8,876,604 B2 11/2014 Casino
8,900,099 B1 12/2014 Boyette
9,861,856 B1 1/2018 Miller
10,188,890 B2 1/2019 Olson
10,307,641 B2 * 6/2019 Orfield ..... A63B 22/0076
10,376,732 B2 * 8/2019 Garsdean ..... A63B 23/03525
10,486,015 B2 * 11/2019 Valente ..... A63B 24/0062
10,661,112 B2 * 5/2020 Orady ..... A63B 71/0054
10,751,559 B2 8/2020 Constanza
11,058,917 B1 7/2021 Hutt
11,406,861 B2 * 8/2022 Lafrance ..... A63B 24/0087
2002/0077224 A1 6/2002 Slawinski
2004/0235593 A1 11/2004 Duflon
2006/0229163 A1 10/2006 Waters
2008/0119763 A1 5/2008 Wiener
2008/0318740 A1 * 12/2008 Ross ..... A63B 21/063 482/92
2010/0125026 A1 * 5/2010 Zavadsky ..... A63F 9/24 482/5
2010/0137114 A1 * 6/2010 Keiser ..... A63B 21/155 482/112
2011/0152045 A1 * 6/2011 Horne ..... A63B 21/0628 482/131
2011/0165996 A1 7/2011 Paulus
2012/0015784 A1 * 1/2012 Reed ..... A63B 21/153 482/131
2014/0038777 A1 2/2014 Bird
2014/0142864 A1 5/2014 Spears
2014/0194250 A1 7/2014 Reich
2014/0213414 A1 7/2014 Balandis
2014/0221164 A1 8/2014 Siniora
2014/0296750 A1 * 10/2014 Einav ..... A63B 21/4047 601/5
2015/0081057 A1 3/2015 Hamada
2015/0190675 A1 7/2015 Silagy
2015/0290512 A1 10/2015 Montgomery
2015/0296020 A1 10/2015 Granqvist
2015/0367162 A1 * 12/2015 Mueller ..... A63B 21/154 482/94
2016/0101320 A1 4/2016 Tsutsui
2016/0146643 A1 5/2016 Martin
2016/0158603 A1 * 6/2016 Darwood ..... A63B 24/0062 482/5
2016/0310789 A1 10/2016 Emerson
2016/0325141 A1 11/2016 Wu
2016/0332019 A1 11/2016 Rollins
2016/0375292 A1 12/2016 Taft
2017/0014669 A1 1/2017 Hall
2017/0036063 A1 2/2017 Goldston
2017/0203143 A1 * 7/2017 Ferlito ..... A63B 24/0087
2017/0234706 A1 8/2017 Martin
2017/0246507 A1 8/2017 Kennington
2017/0304679 A1 10/2017 Orfield
2017/0319931 A1 11/2017 Yachin
2017/0368413 A1 12/2017 Shavit
2018/0015319 A1 1/2018 Lagree
2018/0021614 A1 1/2018 Taft
2018/0021629 A1 * 1/2018 DeLuca ..... A63B 21/00069 482/4
2018/0117432 A1 5/2018 Aliberti
2018/0188850 A1 7/2018 Heath
2018/0214730 A1 * 8/2018 Larose ..... A61H 1/0237
2018/0243600 A1 8/2018 Kennington
2018/0285496 A1 10/2018 Le Chevalier
2019/0091511 A1 3/2019 Christoforou
2019/0159714 A1 5/2019 Nagasu
2019/0175092 A1 6/2019 Gold
2019/0269967 A1 9/2019 Thomas
2019/0290962 A1 * 9/2019 Osbrink ..... A63B 24/0062
2019/0299049 A1 10/2019 Parsian
2019/0344123 A1 * 11/2019 Rubin ..... A63B 21/153
2020/0047027 A1 2/2020 Ward
2020/0047030 A1 2/2020 Ward
2020/0047053 A1 2/2020 Ward
2020/0047054 A1 2/2020 Ward
2020/0047055 A1 2/2020 Ward
2020/0054914 A1 2/2020 Lafrance
2020/0054929 A1 * 2/2020 Ward ..... G06V 10/143
2020/0139187 A1 * 5/2020 Kennington ..... A63B 71/0622
2020/0222760 A1 7/2020 Padgett
2020/0289890 A1 * 9/2020 Kim ..... G01C 19/00
2020/0316424 A1 * 10/2020 Orady ..... A63B 23/1281
2021/0063256 A1 3/2021 Davis
2021/0187339 A1 6/2021 Miller
2021/0244995 A1 8/2021 Andrei

* cited by examiner

RACKING AND UNRACKING EXERCISE MACHINE

CROSS REFERENCE TO OTHER APPLICATIONS

This application is a continuation of U.S. patent application Ser. No. 17/856,423, entitled RACKING AND UNRACKING EXERCISE MACHINE filed Jul. 1, 2022 which is incorporated herein by reference for all purposes, which is a continuation of U.S. patent application Ser. No. 17/178,154, entitled RACKING AND UNRACKING EXERCISE MACHINE filed Feb. 17, 2021, now U.S. Pat. No. 11,406,861, which is incorporated herein by reference for all purposes, which is a continuation of U.S. patent application Ser. No. 16/538,713, entitled RACKING AND UNRACKING EXERCISE MACHINE filed Aug. 12, 2019, now U.S. Pat. No. 11,426,618, which is incorporated herein by reference for all purposes, which claims priority to U.S. Provisional Application No. 62/718,886, entitled RACKING AND UNRACKING EXERCISE MACHINE filed Aug. 14, 2018 which is incorporated herein by reference for all purposes.

BACKGROUND OF THE INVENTION

Strength training at home is convenient but often done alone, without the assistance of trained staff. Strength training includes performing movements with high weight that may endanger a user, be awkward for a user, or be difficult for a user to start alone.

BRIEF DESCRIPTION OF THE DRAWINGS

Various embodiments of the invention are disclosed in the following detailed description and the accompanying drawings.

DETAILED DESCRIPTION

Figure 1A:
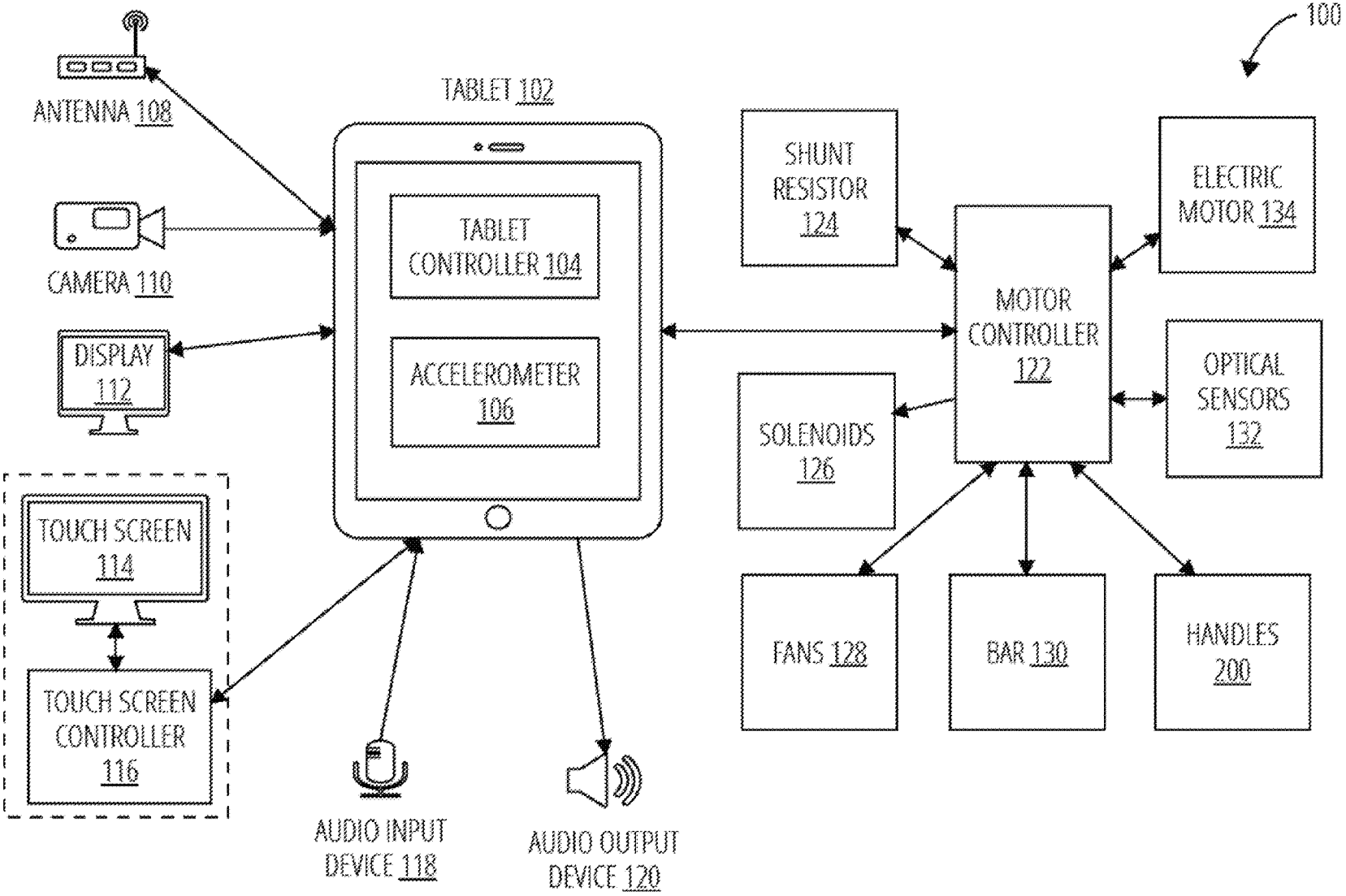
FIG. 1A is a block diagram illustrating an embodiment of a system for digital weight racking and unracking.

The invention can be implemented in numerous ways, including as a process; an apparatus; a system; a composition of matter; a computer program product embodied on a computer readable storage medium; and/or a processor, such as a processor configured to execute instructions stored on and/or provided by a memory coupled to the processor. In this specification, these implementations, or any other form that the invention may take, may be referred to as techniques. In general, the order of the steps of disclosed processes may be altered within the scope of the invention. Unless stated otherwise, a component such as a processor or a memory described as being configured to perform a task may be implemented as a general component that is temporarily configured to perform the task at a given time or a specific component that is manufactured to perform the task.

As used herein, the term 'processor' refers to one or more devices, circuits, and/or processing cores configured to process data, such as computer program instructions.

A detailed description of one or more embodiments of the invention is provided below along with accompanying figures that illustrate the principles of the invention. The invention is described in connection with such embodiments, but the invention is not limited to any embodiment. The scope of the invention is limited only by the claims and the invention encompasses numerous alternatives, modifications and equivalents. Numerous specific details are set forth in the following description in order to provide a thorough understanding of the invention. These details are provided for the purpose of example and the invention may be practiced according to the claims without some or all of these specific details. For the purpose of clarity, technical material that is known in the technical fields related to the invention has not been described in detail so that the invention is not unnecessarily obscured.

Racking and unracking a digital weight is disclosed. Strength training includes performing movements that include getting into an awkward starting position, moving with high weight, unracking the weight under load in a difficult position, and racking the weight while in a difficult position. Traditionally, "racking" a weight means physically placing a weight on a metal rack so that the rack bears the load rather than a user. Traditionally, "unracking" means removing a weight from the metal rack so that a user bears the load. As referred to herein, a "digital weight" is any load for a user of a strength trainer that uses electricity and a digital controller to generate, control, and/or direct tension/resistance. One example of such a strength trainer is one where a user's handle/actuator is coupled via a cable to a motor controlled at least in part by a filter. The filter is controlled by a digital controller to dynamically adjust torque on the motor to make physical exercise more efficient, effective, safe, and/or enjoyable for the user.

In one embodiment, racking and unracking digital weights comprises a strength training machine setting a weight but not applying it until the user is ready, being able to quickly offload the weight so the user may shift position easily and try again, and/or adding the weight clearly/smoothly/predictably such that the user may react effectively. The machine also communicates when the weight has made progress unracking, providing an easily accessible rack activation mechanism without compromising safety. For a machine with load-bearing cables, a quick method of minimizing load on the cables improves safe operation. Certain exercises are performed by minimizing the load in certain directions, such as concentric or eccentric.

Concentric movements are when muscles contract under load, for example using a bicep muscle to initiate lifting a weight. Isometric movements are when a muscle remains stable or at the same position under load, for example once the bicep muscle has lifted the weight, isometric movement is holding the weight in place. Eccentric is when a muscle lengthens under load, for example using a bicep muscle to resist gravity as the weight is being lowered back down.

In one embodiment, the system enables a user to instruct an exercise device to "rack" the weight, defined as reducing the load being placed on the cables, and to "unrack" the weight, defined as increasing this load to a higher, typically preset, level. These concepts may be applied to all movements pertaining to strength training, regardless of the direction of the load in relationship to the user.

Racking and unracking digital weight improves user strength training in three ways: (1) safety for the user; (2)

safety for the machine; and (3) function. With regard to user safety and/or machine safety, during an exercise, a user might feel that resisting the load on the cables has become too strenuous. In this case, instructing the machine to rack or release the load saves the user from potential injury. In another safety scenario, the user or machine may have selected a weight that is too heavy, so that when the user instructs the machine to unrack or generate the load, the user is unable to manage the load.

With regard to function, various exercises are enabled by this system that are not available using standard gym strength equipment constrained by gravity without assistance, for example body weight, free weight, fixed-track, and gravity-and-metal based cable machines. For example, some exercises require the user to pull on the cables just to get into the position to start the exercise. If the load is too high, the user may not be able to get into position or may cause discomfort or injury. But with the load released, the user may be able to exercise with greater loads than would be available when solo lifting in a standard gym.

For example, consider eccentric-based exercises. Some exercise commentators suggest purely eccentric strength workouts, but in a standard gym, gravity requires user effort. For instance, for a shoulder press, a user in a gym could press up a dumbbell with two hands, then at the top, release one hand while letting the other arm slowly lower the dumbbell. This requires concentric effort on the way up and places the user closer to exhaustion risk if the dumbbell is too heavy for the user. With racking and unracking of digital weights, the user may rack the cable load in the concentric direction, then unrack the load in the eccentric direction without requiring concentric effort. Furthermore, if the load proves to be too strenuous in the eccentric direction, the user may instruct the motor to rack the load.

Indicating the release and enablement of the motor load may be accomplished in various ways. In one embodiment, a handle includes a button that when pressed, unracks the load, and when pressed again, racks the load. In one embodiment, a bar, when tilted, racks the load and when leveled, might unrack the load. In one embodiment, voiced instructions by the user may be used to rack and unrack the load. In one embodiment, the indication to rack the load originates, not from the user explicitly, but rather from the machine or a coach. Other techniques for the user to indicate to rack or unrack a digital weight are described below.

FIG. 1A is a block diagram illustrating an embodiment of a system for digital weight racking and unracking. In one embodiment, a rack/unrack system (100) comprises a tablet (102), an antenna (108), a camera (110), a display (112), a touch screen (114), a touch screen controller (116), an audio input device (118), an audio output device (120), a motor controller (122), a shunt resistor (124), solenoids (126), fans (128), a bar (130), optical sensors (132), an electric motor (134), and handles (200). The motor controller (122), the bar (130) and handles (200), and the electric motor (134) are exemplary controllers, exercising components, and resistive devices, respectively.

The tablet (102) may further comprise a tablet controller (104) and an accelerometer (106). The tablet controller (104) sends and receives control signals to and from various other components, such as the antenna (108), the camera (110), the display (112), the touch screen controller (116), the audio input device (118), the audio output device (120), and the motor controller (122). Furthermore, the antenna (108), the camera (110), the display (112), the touch screen (114), the touch screen controller (116), the audio input device (118), the audio output device (120), and the motor controller (122) may be integrated into the tablet (102) or may be external components. In one embodiment, antenna (108) is connected to motor controller (122), and one or more of handles (200) and bar (130) are connected wirelessly to motor controller (122).

For example, the tablet controller (104) may receive a control signal from the motor controller (122) that an unracking event has concluded, and the tablet controller (104) may then send another control signal to the audio output device (120) to operate the audio output device (120) to generate an audio confirmation of the conclusion of the unracking event. The tablet (102) may communicate wirelessly, such as by WiFi, Bluetooth, or NFC, without limitation, or through a wired connection such as USB or Ethernet, without limitation. The accelerometer (106) may be integrated into the tablet (102). The accelerometer (106) may send control signals to the tablet controller (104) regarding the orientation of the tablet (102).

The antenna (108) may be utilized to communicate with external components. The antenna (108) may utilize WiFi, Bluetooth, or NFC, without limitation, to communicate.

The camera (110) may receive visual inputs and send those inputs to the tablet controller (104). The camera (110) and/or the tablet controller (104) may utilize facial recognition logic to determine a specific user. The camera (110) may also help determine a user state that may indicate an indicated racking. For example, the camera (110) may determine that the degree of tilt of the bar (130) is beyond a preset limit. The degree of bar tilt may also be determined by the tablet controller (104) or motor controller (122) from the signals received from the camera (110). In one embodiment, the camera (110) may determine facial cues and/or other user cues indicate a need for racking.

A wired or wireless (108) fitness monitor (not shown in FIG. 1A) may send inputs to the tablet controller (104). For example, the fitness monitor may include a heart rate monitor and/or SpO2 monitor which may be utilized to indicate abnormal user conditioning and/or alarm that may indicate a racking on behalf of the user, for example if they are in great pain, cardiac arrest, and/or stop breathing. A wired or wireless (108) grip sensor monitor (not shown in FIG. 1A) that detects grip may send inputs to the tablet controller (104). For example if the user's grip strength increases in panic or slacks as they lose consciousness, these may be utilized to indicate abnormal user conditioning that may indicate a racking on behalf of the user.

The display (112) receives control signals from the tablet controller (104) and is configured to present visual data. The visual data may include status of the electric motor (134) as to whether it is in a racking or unracking state, weight engaged, notifications of a change in state of the electric motor (134), without limitation.

The touch screen (114) and the touch screen controller (116) may operate similarly to the display (112). However, the touch screen controller (116) may enable control signals to be sent to the tablet controller (104) or motor controller (122) based on the visual data being displayed. For example, the touch screen (114) may display "UNRACK?". The touch screen controller (116) may receive a haptic input corresponding to the "UNRACK?" and send a control signal to the motor controller (122), for example via the tablet controller (104), to indicate an unracking event.

In one embodiment, there is no display (112), and touch screen (114) performs the functions described above for both display (112) and touch screen (114).

The audio input device (118) converts sound into control signals. Logic may be operated on the control signals to determine an action by the rack/unrack system (100). For example, the audio input device (118) may receive the sound, "Rack" or "help" and interpret the sound as an indication the user wishes to rack the digital weight. The control signal may then operate the motor controller (122) to perform a racking event from the current state of the rack/unrack system (100). The audio input device (118) may also be utilized to help indicate a racking event. The audio input device (118) and associated logic may determine that specific sounds or sets of sounds indicate that a user is struggling, and a racking event is to be indicated.

The sounds may be combined with other signals to indicate a racking event. The audio output device (120) may receive control signals and output audio in response to an initiation indication. For example, after an unracking event has been indicated but prior to the electric motor (134) being signaled, the audio output device (120) may receive a control signal to emit, "Unracking initiated". To continue the exemplary scenario, after the electric motor (134) has completed loading the weight, the audio output device (120) may receive a control signal to emit, "Unracking complete". The audio output device (120) may emit other warnings, indications, or music. A non-exhaustive list of feedback without limitation may include "racked", "unracked started", "unracking in process" for example a continuous sound across a ramping of unracking as digital weight is increased, "unracked complete" for example tightly coupled to the above continuous ramp sound.

The motor controller (122) sends and receives control signals from the tablet (102), the shunt resistor (124), the solenoids (126), the fans (128), the bar (130), the optical sensors (132), and the electric motor (134). The motor controller (122) may coordinate the operation of those components to operate the rack/unrack system (100), such as to rack or to unrack.

The shunt resistor (124) may be utilized to help determine the operating state, for example the electrical current, of the electric motor (134), or other electrical component. The shunt resistor (124) may send a control signal to the motor controller (122) regarding the current or other electrical parameter. The motor controller (122) may utilize the control signal to alter the operation of the electrical components or to generate a control signal to alter the operation of the tablet (102), such as to display the current state of the rack/unrack system (100) on the display (112).

The solenoids (126) are operated by control signals from the motor controller (122). When the user is reconfiguring the machine, for example sliding the arms up and down, rotating or pivoting them and so on, the solenoids may assist the machine is becoming aware of this reconfiguration.

The fans (128) are operated by control signals from the motor controller (122). The fans (128) may be utilized to cool the electrical components, such as the motor, via convective cooling. The motor controller (122) may determine whether the components are overheating via sensors, or utilize a pre-set algorithm to initiate the fans (128) based on operations of the electrical components. In one embodiment, the machine may rack the weight upon overheating to prevent damage to the machine and/or starting a fire.

The optical sensors (132) may provide control signals to the motor controller (122) regarding the operational state of the rack/unrack system (100). The motor controller (122) may utilize the optical signals to rack, unrack, provide notifications, and so on.

The electric motor (134) receives control signals from the motor controller (122) and operates in response. The electric motor (134) may be utilized to rack or unrack weights by providing a first force on the weights until a given setpoint is reached, which may be determined by the motor controller (122). The electric motor (134) may operate to provide the first force in an increasing or decreasing manner, thus adding or removing weight in a controlled manner. The electric motor (134) may operate via a logistics curve. The electric motor (134) may also receive periodic signals from the motor controller (122) that determine the operating characteristics of the electric motor (134).

The handles (200) may be mechanically coupled to a resistive component, such as digital weights, weights, and/or a tension device. The handles (200) may be utilized by a user to move the resistive component, thereby exercising by transforming the force applied to the handles (200) to force applied to the resistive component. The handles (200) may send control signals to the motor controller (122) regarding the state of the handles (200).

There are three main aspects to racking/unracking: (1) the indication to rack/unrack, (2) the execution of rack/unrack, and (3) the communication of rack/unrack.

An indication to rack/unrack may include the command that is delivered to motor controller (122) to rack or unrack the weight. The user may explicitly issue this command and/or may do in a number of different ways, as described herein. Alternatively, the machine may decide to rack, and perhaps to unrack, upon the occurrence of certain conditions, as described herein. In a third way, a remote coach might indicate the rack and unrack instructions.

Methods of explicit user instructions to rack or unrack include pressing a physical button, tilting an exercise bar, vocalizing the instruction, gesturing to a camera and tapping buttons on tablet (102).

One way for the user to make this instruction is by pressing and releasing a button on the handles (200). In one embodiment, this press and release serves as toggle function. In one embodiment, a first press and release indicates a "rack", and a second one indicates an "unrack". In one embodiment, the user continues to press a button to indicate the "unracked" instruction and releases the button to indicate "racked". In one embodiment, the physical buttons are on a foot pedal, or embedded into a mat or an exercise bench. These physical buttons may take the form of joystick, pressure sensors, a weight control wheel on handles (200), and/or controls on connected peripherals, for example a watch connected wirelessly, or a touch sensor on handles (200) through which motor controller (122) could detect hand gestures meaning "rack" or "unrack".

Some exercises, for example bench press, might use a bar (130) oriented horizontally. To issue a "rack" indication, the user tilts bar (130) substantially off the horizontal voluntarily or involuntarily, for example if the user is losing control of the bar. Bar (130) may send control signals to the motor controller (122) regarding the state of the bar (130). For example, bar (130) may send its position, the relative position of grasping components, and so on. Bar (130) may further include buttons, accelerometer/gyroscope, resistive or capacitive touch sensor, or other operating devices, that may be utilized to alter the state of the rack/unrack system (100). For example, bar (130) may include a racking button and an unracking button to indicate the racking event and the unracking event, respectively. Bar (130) may further include a visual or audio device to provide warnings and notifications to a user. Upon racking, whether explicitly instructed or indicated, the machine may inform the user that the racking event has been requested by providing the user with one or more of haptic feedback, and visible or audible response.

In one embodiment, bar (130) may be mechanically coupled to a resistive component, such as digital weights, weights and/or a tension device, which are coupled to the electric motor (134). The bar (130) may be utilized by a user to move the resistive component, thereby exercising by transforming the force applied to the handles (200) to force applied to the resistive component.

Another way for the user to instruct racking or unracking involves the user tapping, typically with a finger, "rack"/"unrack" buttons on tablet (102).

Given the user may be bearing a load when they issue the rack instruction, the ability to vocalize the instruction is convenient. Under this method, the user speaks out loud saying, for example, "rack" or "unrack", thereby indicating the machine to start racking or unracking. The user's vocalized instructions are received by audio input device (118).

Beyond these explicit user instructions, motor controller (122) might also determine to rack the weight upon the occurrence of certain events or conditions as a proxy for the user. These events may include a sudden increase in tension of a cable referred to herein as a "jerk", the tension of the cable being static for a period of time, the length of the cable, patterns in accelerometer and gyroscope measurements tracking the user's motion, patterns and asymmetries in the left and right cable length and speed of extraction, and the cable starting an unusual, unexpected and sudden reversal of direction.

In one embodiment, a motor controller (122) decision to rack as a proxy for the user arises from at least one of following events and conditions: (1) the machine uses a camera to watch for and detect the user struggling or the user using poor form, particularly bad form that may lead to user injury; (2) the machine detects sudden weight changes above a threshold through the motor, indicating that the user has let go of the handles or that a component has broken; (3) the machine detects that the user is presently configuring the machine—for example, situating the arms, unlocking the solenoids, and so on; (4) the machine detects that it is improperly mounted or leaning, which could result from an earthquake; (5) machine failure due to, for example, overheating or blown electrical components; (6) the cables are fully retracted for a period longer than the duration of an exercise rep wherein racking in this case helps avoid overheating the motor; (7) the machine using range finding to detect that the accessories such as the bar (130) and/or handle (200) for example, are in unusual positions meriting racking.

In one embodiment, the system may elect to "rack" the weight as a proxy for the user to assist with the pace and cadence of a workout. In this embodiment, a user is participating in a guided workout, whether group or solo, with controlled rep goals and quick transitions for which keeping pace is important. When a user meets rep goals or specific time durations, a sound plays and the weight is slowly racked for them, encouraging them to attend to instructions or to get into position for the next movement in their workout. When ready, the user unracks the weight.

The third category of racking and unracking indication involves a remote coach issuing these indications as a proxy for the user. In one embodiment, a personal trainer coach interacts remotely with a user exercising on a machine. The coach and the user's machine communicate through a server over a network. Through this communication, commands traveling from the server to the user's machine are the same kinds of commands that typically travel within the machine. Among those typical commands are "rack" and "unrack" commands. A user's remote coach may watch the user exercising, make a professional determination that the user would benefit from racking the weight, and indicate, via a mobile device or website and through the server, to the user's machine to rack the weight. When ready, the coach may issue an "unrack" instruction.

The motor controller (122) signals to rack or unrack by racking or unracking the motor load. The rack and unrack commands, as such, may not be sent from the motor controller (122) to the electric motor (134) instantly. Instead, the motor controller (122) may ramp the weight over time and send the desired weight at each instant of time to the electric motor (134). Those messages may be sent at high frequency, for example 15 kHz.

The electric motor (134) may not be able to determine that the weight is ramping in time; the electric motor (134) merely applies a provided weight at each discrete time. In this scenario, the motor controller (122) determines the rack/unrack and weight ramping. The weight may be ramped both when unracking, or increasing weight, and racking, or decreasing weight, following a specific function over time that may feel more natural for the user and increases safety. In one embodiment, the function is similar to the shape of a logistic curve and/or S-curve.

Figure 1B:
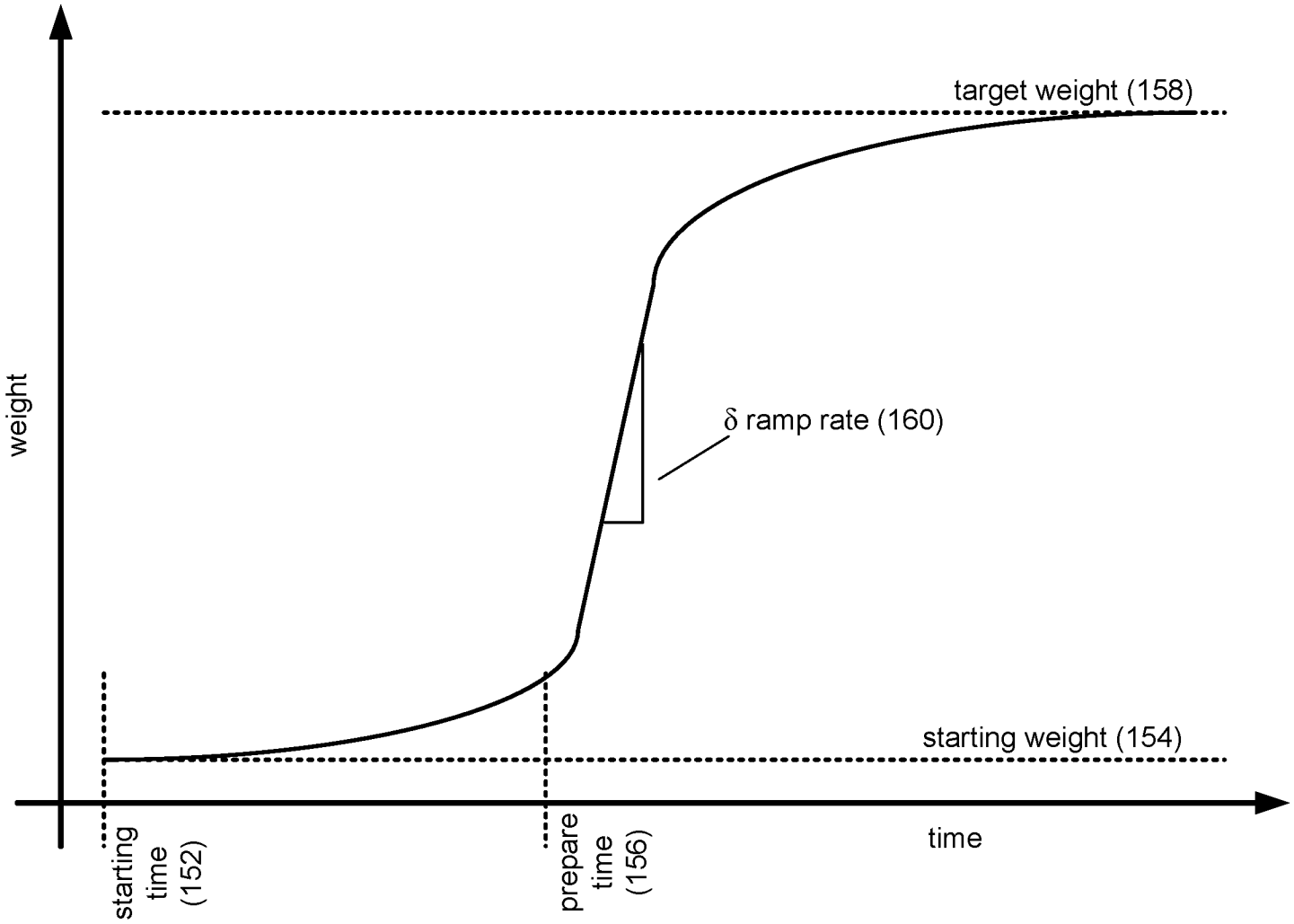
FIG. 1B is an illustration of an S-curve.

FIG. 1B is an illustration of an S-curve. The S-curve, or ramping, aids in the event there is no way to prepare a user with a message to "brace yourself" with the precision of a digital weight action. For example, without an S-curve, a modest 10 lb force applied to a digital weight is quite jarring and an actuator may be inadvertently released from a user's grip which may not be safe. As shown in FIG. 1B, the S-curve may be plotted along a horizontal axis of time versus a vertical axis of applied weight. There is a starting time (152) for the starting weight (154), here shown to be a minimal amount for an unracking. Weight is gently applied at first until the user becomes mentally prepared at time (156). A δ ramp rate (160) is then applied more vigorously, shown in FIG. 1B to be linearly without limitation. As the applied weight approaches a large percentage, say 80% of the target weight (158), further weight is applied more slowly to reach the target weight more slowly.

In one embodiment, the motor controller (122) signals to the electric motor (134) at high frequency that determines the new weight to be applied. The ramping of the weight may further be altered based on the levels of weight. The ramp angle and speed may be different for each level of target weight. A first level may be 20 lbs and less. The operation may be: a notification (sound), 1000 ms, message (sound), increase weight to 15% of target weight at 10 units, wherein unit is ramp rate, for example: lbs/sec; increase weight to 100% of target weight at 18 units, and a ding (sound). A second target weight level may be 20-40 lbs. The operation may be: notification (sound), 1000 ms, message (sound), 10% at 20 units, 40% at 40 units, 70% at 35 units, 100% at 20 units, and a ding (sound). The third level may be 40 lbs. The operation may be: a notification (sound), 1000 ms, message (sound), 10% at 20 units, 20% at 30 units, 70% at 50 units, 100% at 30 units.

The motor controller (122) may, instead, perform each ramp in a pre-set amount of time, for example 3 seconds, or some combination, therein. For example, it may ramp the first 50% of the weight in one second then ramp to 75% of target weight at 10 units then ramp to 100% of the weight at 15 units.

The ramping of weight may additionally be altered based on specific user attributes such as experience lifting a given weight, and/or physical characteristics such as strength assessment or body balance, and/or may be altered based on the specific body positions, movements or types of movements about to be performed by a user. For example an S-curve may be different for a bench press versus a lateral pull-down.

The motor controller (122) may include instructions to prevent a user from performing too heavy of a lift. The motor controller (122) may determine the speed of the weight and indicate a racking if that speed is greater than a threshold amount, for example, if the user is lifting at a weight that is greater than their "one rep max" (1RM), referred to herein as the amount a user could lift if only doing one rep, for a specified movement. The motor controller (122) may further suggest a different weight based on the speed of the previous weight.

The motor controller (122) may include safety logic to interpret button presses, including to determine a response to multiple rack/unrack button presses or button presses for different duration, for example a "long press". The motor controller (122) may ignore and/or reroute signals from devices that are beyond a preset distance from the machine or may ignore and/or reroute signals from devices not in motion or devices that are not connected or not being used for the current strength training movement or are connected to a different device. Furthermore, the motor controller (122) may limit unracking to the device that had previously racked the device. For example, if a handle racked the weight, then the bar could not be utilized to unrack the weight. The motor controller (122) may enable any device to unrack after a pre-set amount of time.

The motor controller (122) may determine that a double press within a predetermined amount of time, such as 0.5 seconds is a single press. Additionally, a button press while another button is held down may be determined to be a single press. If one of these scenarios occurs, if the rack/unrack system (100) is in an unracked state, the motor controller (122) indicates a racking event. Safety logic may be used when it is unclear whether to rack or unrack, to default to a safe 'rack' state.

During an unrack ramp, if a user taps to rack, the rack event takes priority over all other events for safety. After an unrack, any subsequent click may be interpreted as a "rack" event, no matter the timing. The motor controller (122) may also detect motion during an unrack event, such as displacement of a cable, which may indicate a racking event. In one embodiment, the motor controller (122) performs the racking event if the cable displacement occurs within a predetermined time period, for example one second, of an unrack event. The motor controller (122) may further send a control signal to the display (112), the touch screen (114), the audio output device (120), etc. to display or emit a notification if such a racking occurs.

After or during the rack/unrack, the motor controller (122) may send control signals to various components, such as the tablet (102), the display (112), the audio output device (120), the bar (130), the handles (200), etc. to communicate to the user that the motor controller (122) has racked or unracked the motor load according to the user's instruction. The motor controller (122) may further communicate the speed of the ramping.

Figure 2:
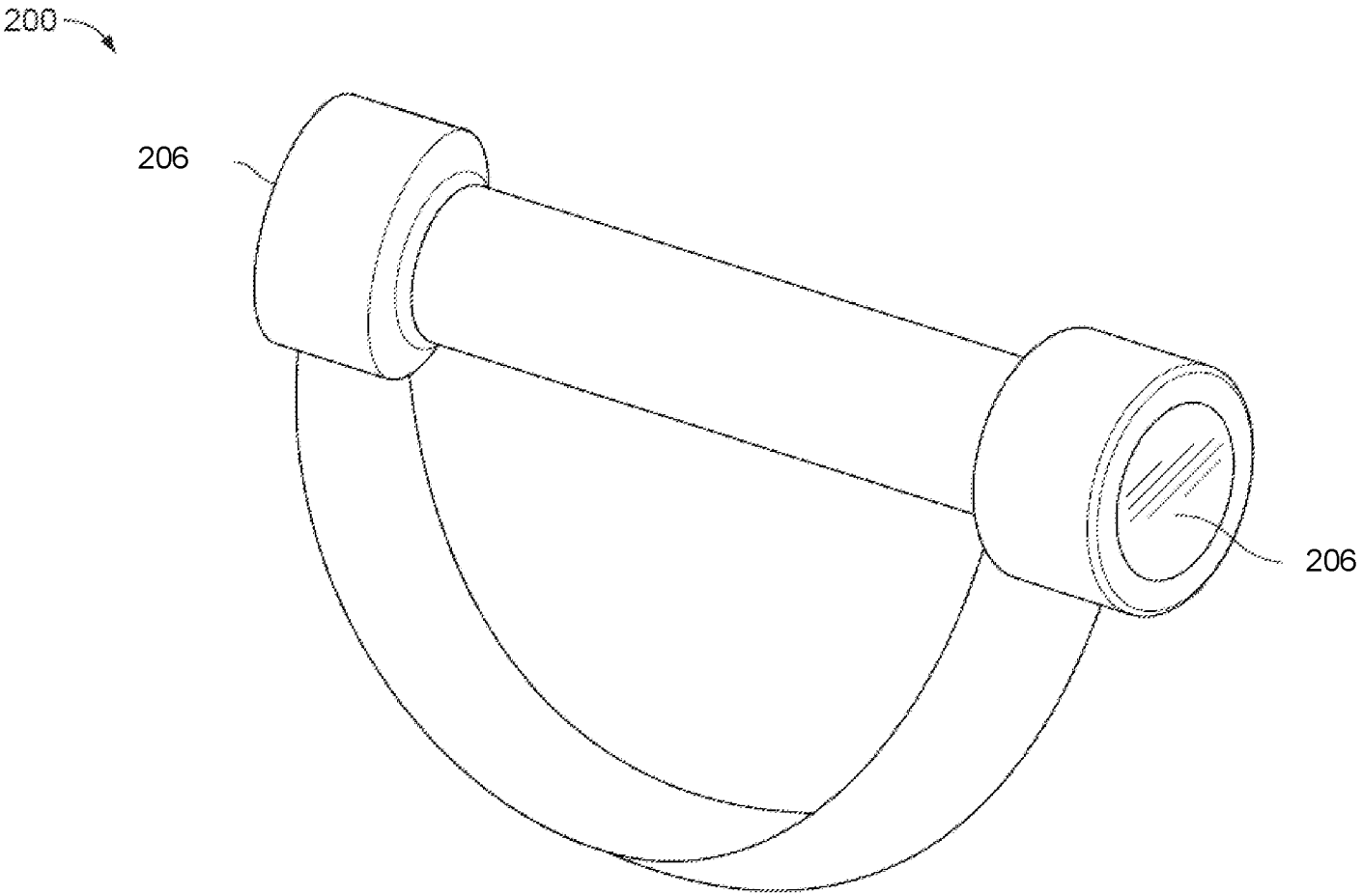
FIG. 2 illustrates one embodiment of an actuator.

FIG. 2 illustrates one embodiment of an actuator. In one embodiment, the actuator includes a single handle (200), including racking/unracking buttons (206) on either end of handle (200). Handle (200) may include further buttons, audio emitters, or visual displays that may alter or depict the state of the rack/unrack system (100). The rack/unrack buttons (206) may indicate a racking event or an unracking event, respectively, when pressed. Buttons (206) operate in a toggle fashion, with the press equating to an instruction opposite to the current state of the system. That is, if the machine is unracked at the time button (206) is pressed, button (206) serves as a racking button. The opposite may be true if the machine is racked.

Handle (200) may further include a visual or audio device to provide warnings and notifications to a user, such as low battery, racked, unracked, and so on. The buttons on handle (200) may be positioned to be reached by a user during operation. For example, when two handles (200) are grasped, each in one hand, the racking/unracking buttons (206) may be reached by each thumb of the user.

Pressing the buttons sends a control signal to the motor controller (122) to indicate a racking or unracking event based on the state of the rack/unrack system (100). Handle (200) may further include an accelerometer, which may provide an indication of whether handle (200) is being utilized. Handle (200) may also provide an indication of the distance from the machine. When the handles are further than a preset distance, the racking buttons (206) and the unracking buttons (208) may not indicate their respective events.

Additionally, if handle (200) indicates an unracking event and is moved to beyond the pre-set distance, a racking event may be signaled. Handle (200) may also not communicate the initiation of an event to the motor controller (122) unless a button is pressed twice. In one embodiment, the double press is only utilized for the unracking function. In other embodiments, for racking, any press racks immediately. Another press to "unrack" may register only if the press occurred at least 1.5 seconds later. For unrack press commands, the unrack may start on any press, while another press "racks" immediately.

Sounds may be emitted from handle (200) or tablet (102) to denote that unracking has begun, occur throughout the duration of the unracking event, and occur when complete. The sounds may be altered for each phase. Further sounds may be emitted for racking initiation, racking duration, and racking completion.

In one embodiment, one of the two handles (200) serves as a racking handle, with the other serving as an unracking handle. In one embodiment, both handles (200) serve as racking and unracking handles, but one of the two buttons (206) serves as a racking button, and the other serves as an unracking button.

Figure 3:
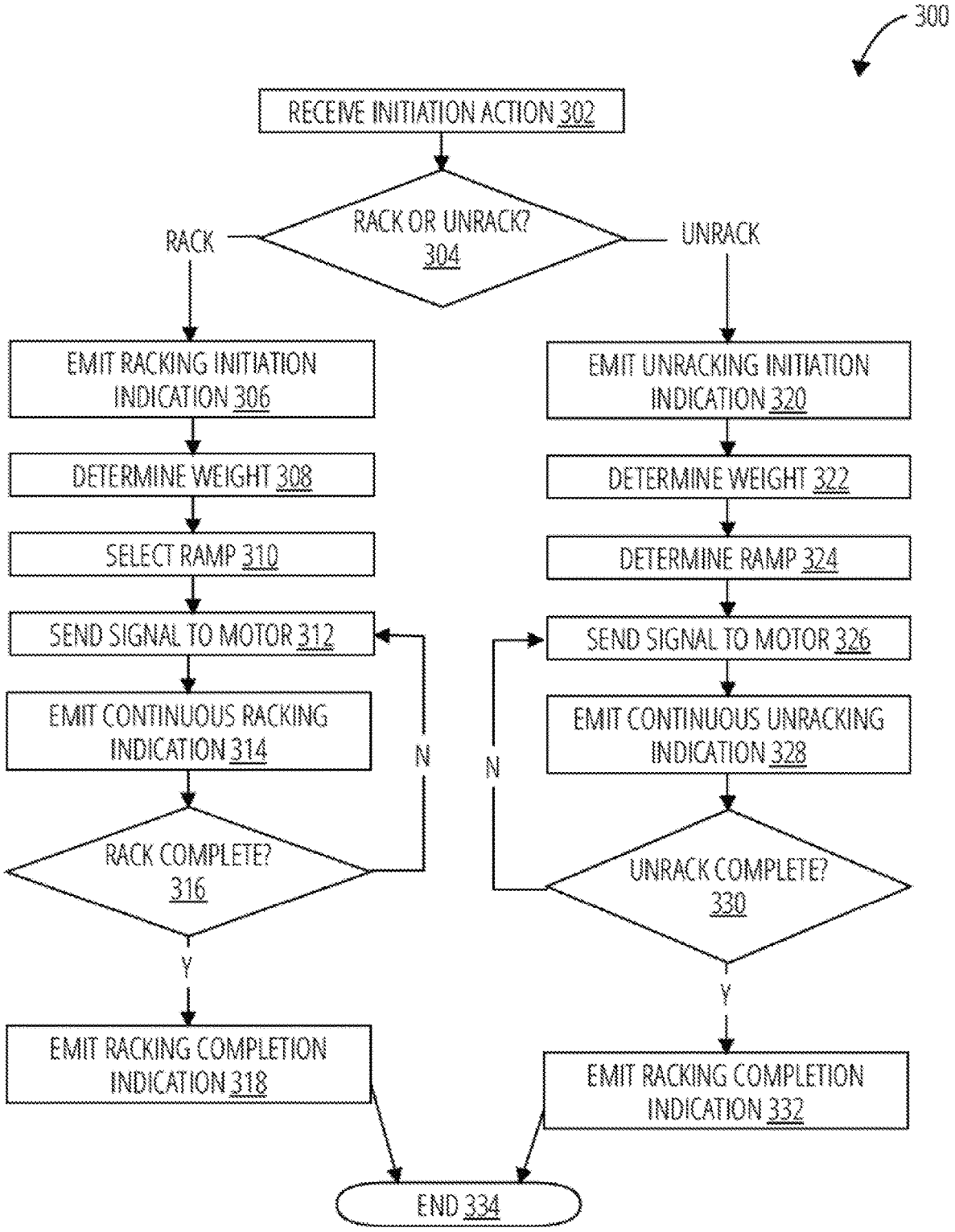
FIG. 3 is a flow chart illustrating an embodiment of a process for racking and unracking digital weights.

FIG. 3 is a flow chart illustrating an embodiment of a process for racking and unracking digital weights. In one embodiment, the process of FIG. 3 is carried out by controller (122) of FIG. 1A. Within the button press racking/unracking technique (300) an indication is received (302). An indication may be an audio input, a visual input, a button press, a haptic input to a touch screen, pressure sensitive glove or other similar device, a specific loading condition, a motion based gesture detected algorithmically by an accelerometer or gyroscope or data from an accelerometer or gyroscope, a gesture detected by a camera, a movement of a cable, and so on. These may be user determined rack or unrack events or may be a user proxied rack or unrack events from the system and/or remote assistance such as a coach.

It is determined based at least in part on a number of inputs, the source of the inputs, the imputed characteristics, whether the system is currently racking or unracking, and so on whether there is a rack event or an unrack event (304).

If a rack event is determined (304), a racking initiation indication is optionally emitted (306). This may be performed visually, audibly, and/or haptically. In this step, it may be determined whether an unracking event is currently being processed and if so, pause the racking until this event is complete. Alternately, in the event an unracking is being processed, the racking may override the unracking for safety.

The target digital weight is determined (308) and a ramp is selected (310), for example an S-curve profile based at least in part on the user and/or movement. Alternately, the ramp is as steep as possible to remove all load from the user as soon as is physically possible for safety. A signal is then sent to the motor based on the selected ramp (312). The signal operates the motor to perform the ramp. While the signal is being sent, a continuous racking indication is emitted (314). In the event (316) the racking is complete, control is transferred to step (318); otherwise signals are continued to be sent to the motor (312), and the continuous racking indication is emitted (314). A racking completion indication is then emitted (318) and the process ended (334).

If an unrack event is determined, an unracking initiation indication is optionally emitted (320). This may be performed visually, audibly, and/or haptically. In this step (320) it may be determined whether an unfinished racking event is still in process, and if so, pause the unracking until this event is complete. Alternately, in the event a racking is being processed, the unracking may be overridden or ignored for safety.

The target digital weight is determined (322) and a ramp is selected (324), for example an S-curve profile based at least in part on the user and/or movement. A signal is then sent to the motor based on the selected ramp (326). The signal operates the motor to perform the ramp. While the signal is being sent, a continuous unracking indication is emitted (328). In the event (330) the unracking is complete, control is transferred to step (332); otherwise signals are continued to be sent to the motor (326), and the continuous unracking indication is emitted (328). An unracking completion indication is then emitted (332) and the process ended (334).

Figure 4:
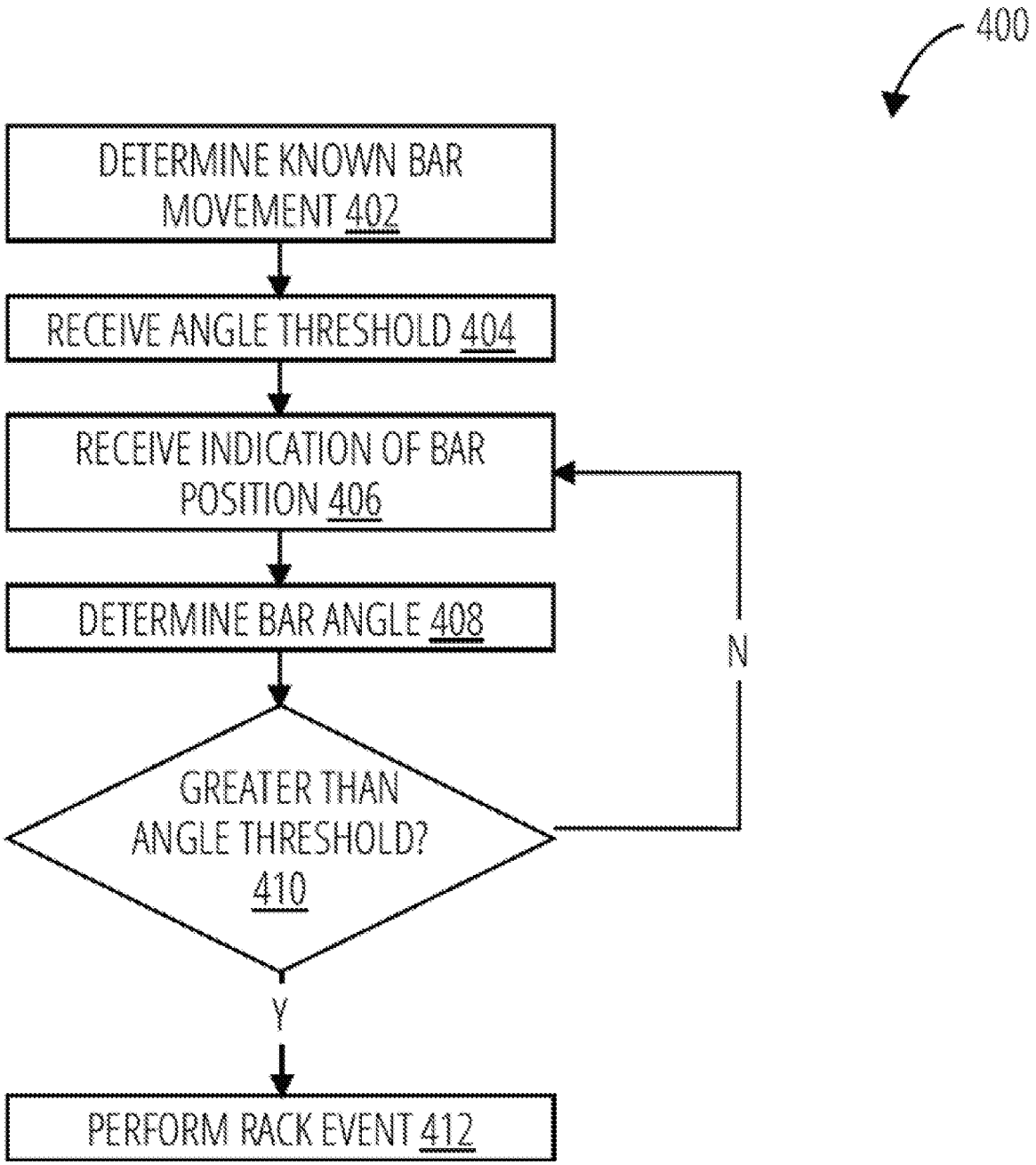
FIG. 4 is a flow chart illustrating an embodiment of a process for a bar tilt response.

FIG. 4 is a flow chart illustrating an embodiment of a process for a bar tilt response. In one embodiment, the process of FIG. 4 is carried out by controller (122) of FIG. 1A. The bar tilt response method (400) determines that a "bar bail" movement is being performed (402). The "Bar Bail" movement is a specific kind of racking instruction that may be given when a barbell is being used. "Bar bail" awareness is enabled when the system becomes aware that the user is engaged in a specified set of movements, for example a bench press or a dead lift.

In one embodiment, a user may input such a specified movement audibly, visually, and/or haptically to be performed that triggers the feature of "tilt" to be enabled. Alternatively, a user may input a generic "bar" movement that triggers the feature of "tilt" to be enabled. A user may also explicitly trigger "tilt" to be enabled through interface elements such as a toggle switch or button on the weight control or other UI element. A user may also enable the "tilt" feature implicitly by engaging in a workout, for example guided or self designed, that identifies movements that trigger the "tilt" feature when the user encounters a movement known to use the bar, for which tilt would be effective and helpful.

In one embodiment, the system may have physical sensors that indicate when a user has attached the bar to the system. This includes specific T locks or other locking mechanisms to support bar attachment, with sensors on the lock receptors on the wrist of the device that identify that a bar has been attached on both sides of the device. Using this example technique or any other that facilitates the system's awareness of a bar being used, "tilt" may be enabled implicitly whenever a user is engaged with the bar.

In one embodiment, at attachment to the bar, such as a bar control module with an accelerometer that may detect motion, may assist with implicitly triggering "bar bail" mode. This device communicates with the trainer when in motion. When the trainer detects that reps are being completed and that the bar control module is in a pattern of motion that aligns with expected patterns for bar repetitions, the system may implicitly trigger the bar tilt feature to enable the user to rack the weight as described above.

An angle threshold is received in step (404). Each known movement may have a different angle threshold. An indication of bar position is received in step (406). The bar may have accelerometers or gyroscopes that may indicate position. A camera may provide visual feedback. The tension or other loading condition, such as cable length, may be determined.

A bar angle is determined from the one or more indications of bar position (408). It is determined in step (410) whether the bar angle is greater than the angle threshold. If not, control is transferred to step (406) wherein an indication of bar position is received again. If the bar angle is greater than the angle threshold, a rack event is performed (412). Thus, if a user is performing a bench press and begins to fail in one arm, tilting the bar beyond the angle threshold will rack the digital weight, to avoid having the bar crush and harm the user under the bar.

In one embodiment, analog systems are used in the detection of previously described rack indication events within the motor controller (122). For example, bar angle may be determined by using an analog pulse counter or comparator from the output of the optical sensor. When the number of pulses or voltage level into the comparator is above a threshold, a signal is sent to the motor controller to rack the weight. In one embodiment, a button press may be detected by the motor controller itself and interpreted as an instruction to rack/unrack weight.

Figure 5:
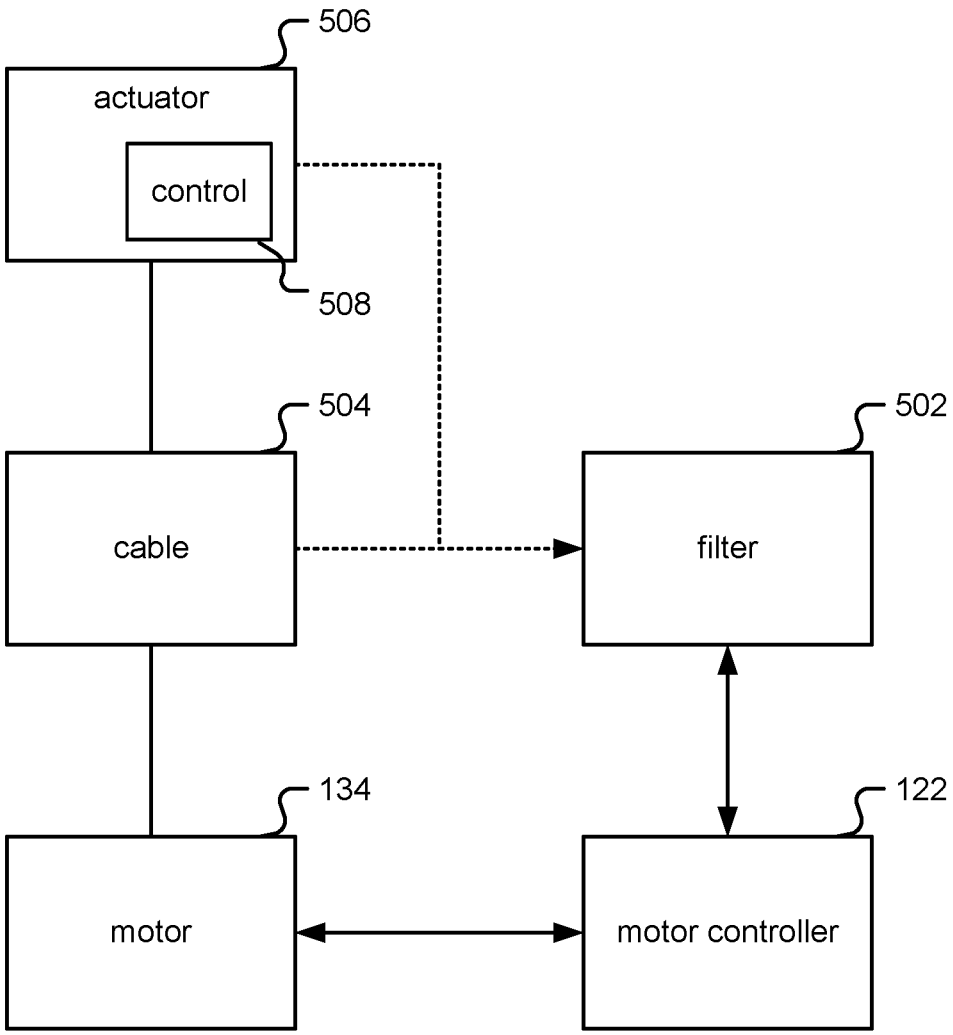
FIG. 5 is a block diagram illustrating an embodiment of a system for racking and unracking digital weight.

FIG. 5 is a block diagram illustrating an embodiment of a system for racking and unracking digital weight. In one embodiment, the system of FIG. 5 is part of FIG. 1A as described below. The system includes the following:

a. a controller circuit (122), which may include a processor, inverter, pulse-width-modulator, and/or a Variable Frequency Drive (VFD);

b. a resistance unit comprising a motor (134), for example a three-phase brushless DC driven by the controller circuit;

c. a spool with a cable (504) wrapped around the spool and coupled to the spool. On the other end of the cable an actuator (506) is coupled in order for a user to grip and pull on. Examples of actuator (506) include handle(s) (200) and bar (130). The spool is coupled to the motor (134) either directly or via a shaft/belt/chain/gear mechanism. A spool may be also referred to herein as a "hub". Thus, the cable (504) is coupled to the motor (134) wherein the motor (134) selectively tensions the cable (504) in accordance with an exercise program as described herein. As described above, the actuator (506) is connected to the cable (504) wherein the actuator (506) is physically arranged to deliver a force to a user wherein the actuator (506) includes a control (508) that signals the motor (134) to apply or remove tension to the cable (504) in response to the user indicating to rack or unrack a digital weight;

d. a filter (502), to digitally control the controller circuit (122) based on receiving information from the cable (504) and/or actuator (506);

e. optionally not shown in FIG. 5, a gearbox between the motor and spool. Gearboxes multiply torque and/or friction, divide speed, and/or split power to multiple spools. Without changing the fundamentals of digital strength training, a number of combinations of motor and gearbox may be used to achieve the same end result. A cable-pulley system may be used in place of a gearbox, and/or a dual motor may be used in place of a gearbox;

f. one or more of the following sensors not shown in FIG. 5: a position encoder; a sensor to measure position of the actuator (506) or motor (100). Examples of position encoders include a hall effect shaft encoder, grey-code encoder on the motor/spool/cable (504), an accelerometer in the actuator/handle (506), optical sensors, position measurement sensors/methods built directly into the motor (134), and/or optical encoders. In one embodiment, an optical encoder is used with an encoding pattern that uses phase to determine direction associated with the low resolution encoder. Other options that measure back-EMF (back electromagnetic force) from the motor (134) in order to calculate position also exist;

g. a motor power sensor; a sensor to measure voltage and/or current being consumed by the motor (134); and/or h. a user tension sensor; a torque/tension/strain sensor and/or gauge to measure how much tension/force is being applied to the actuator (506) by the user. In one embodiment, a tension sensor is built into the cable (504). Alternatively, a strain gauge is built into the motor mount holding the motor (134). As the user pulls on the actuator (506), this translates into strain on the motor mount which is measured using a strain gauge in a Wheatstone bridge configuration. In another embodiment, the cable (504) is guided through a pulley coupled to a load cell. In another embodiment, a belt coupling the motor (134) and cable spool or gearbox (504) is guided through a pulley coupled to a load cell. In another embodiment, the resistance generated by the motor (134) is characterized based on the voltage, current, or frequency input to the motor.

In one embodiment, the actuator (506) comprises a smart accessory (508) wirelessly connected to the resistance unit (122 and/or 134). For example, the actuator (506) comprises a Bluetooth smart accessory wirelessly connected to the resistance unit (122 and/or 134). In one embodiment, the control (508) is a button.

In one embodiment, a voice control (508) is used to rack or unrack the digital weight. In one embodiment, a nominal tension is applied when the digital weight is unracked. For example, unracking the digital weight corresponds to applying tension to the cable. In one embodiment, in response to an indication to unrack the weight, tension is changed first gradually, then more quicky, and then less quickly to reach a desired tension, for example using a ramp and/or S-curve as described above. For example, an amount of jerk when the digital weight is unracked is limited.

In one embodiment, a remote coaching unit (not shown in FIG. 5) also sends rack and unrack commands in addition to or as proxy for user generated commands. In one embodiment, a ramping rate of tension applied is controlled.

In one embodiment, an audible signal is emitted indicating that the digital weight has been unracked. In one embodiment, an audible signal is emitted indicating that the digital weight has been racked. In one embodiment, a haptic cue is emitted that the digital weight has been racked. In one embodiment, a haptic cue is emitted that the digital weight has been unracked.

In one embodiment, in the event a nonstandard orientation of the actuator (506) is detected, the digital weight is racked in response. In one embodiment, the actuator (506) comprises a heart rate sensor to detect heart rate. In one embodiment, the actuator (506) comprises a grip sensor to detect grip.

In one embodiment, a three-phase brushless DC motor (134) is used with the following:

a. a controller circuit (122) combined with filter (502) comprising:
   i. a processor that runs software instructions;
   ii. three pulse width modulators (PWMs), each with two channels, modulated at 20 kHz;
   iii. six transistors in an H-Bridge configuration coupled to the three PWMs;
   iv. optionally, two or three ADCs (Analog to Digital Converters) monitoring current on the H-Bridge; and/or
   v. optionally, two or three ADCs monitoring back-EMF voltage;

b. the three-phase brushless DC motor (134), which may include a synchronous-type and/or asynchronous-type permanent magnet motor, such that:
   i. the motor (134) may be in an "out-runner configuration" as described below;
   ii. the motor (134) may have a maximum torque output of at least 60 Nm and a maximum speed of at least 300 RPMs;
   iii. optionally, with an encoder or other method to measure motor position;

c. a cable (504) wrapped around the body of the motor (134) such that entire motor (134) rotates, so the body of the motor is being used as a cable spool in one case. Thus, the motor (134) is directly coupled to a cable (504) spool. In one embodiment, the motor (134) is coupled to a cable spool via a shaft, gearbox, belt, and/or chain, allowing the diameter of the motor (134) and the diameter of the spool to be independent, as well as introducing a stage to add a set-up or step-down ratio if desired. Alternatively, the motor (134) is coupled to two spools with an apparatus in between to split or share the power between those two spools. Such an apparatus could include a differential gearbox, or a pulley configuration; and/or d. an actuator (506) such as a handle, a bar, a strap, or other accessory connected directly, indirectly, or via a connector such as a carabiner to the cable (504).

In one embodiment, the controller circuit (502, 122) is programmed to drive the motor in a direction such that it draws the cable (504) towards the motor (134). The user pulls on the actuator (506) coupled to cable (504) against the direction of pull of the motor (134).

One purpose of this setup is to provide an experience to a user similar to using a traditional cable-based strength training machine, where the cable is attached to a weight stack being acted on by gravity. Rather than the user resisting the pull of gravity, they are instead resisting the pull of the motor (134).

Note that with a traditional cable-based strength training machine, a weight stack may be moving in two directions: away from the ground or towards the ground. When a user pulls with sufficient tension, the weight stack rises, and as that user reduces tension, gravity overpowers the user and the weight stack returns to the ground.

type application suitable for certain kinds of BLDC motors configured for lower speed and higher torque.

In one embodiment, a requirement of such a motor (134) is that a cable (504) wrapped around a spool of a given diameter, directly coupled to a motor (134), behaves like a 200 lbs weight stack, with the user pulling the cable at a maximum linear speed of 62 inches per second. A number of motor parameters may be calculated based on the diameter of the spool.

User Requirements
Target Weight 200 lbs
Target Speed 62 inches/sec = 1.5748 meters/sec
Requirements by Spool Size

| Diameter (inches) | 3 | 5 | 6 | 7 | 8 | 9 |
|---|---|---|---|---|---|---|
| RPM | 394.7159 | 236.82954 | 197.35795 | 169.1639572 | 148.0184625 | 131.5719667 |
| Torque (Nm) | 67.79 | 112.9833333 | 135.58 | 158.1766667 | 180.7733333 | 203.37 |
| Circumference (inches) | 9.4245 | 15.7075 | 18.849 | 21.9905 | 25.132 | 28.2735 |

By contrast in a digital strength trainer, there is no actual weight stack. The notion of the weight stack is one modeled by the system. The physical embodiment is an actuator (506) coupled to a cable (504) coupled to a motor (134). A "weight moving" is instead translated into a motor rotating. As the circumference of the spool is known and how fast it is rotating is known, the linear motion of the cable may be calculated to provide an equivalency to the linear motion of a weight stack. Each rotation of the spool equals a linear motion of one circumference or $2\pi r$ for radius r. Likewise, torque of the motor (134) may be converted into linear force by multiplying it by radius r.

If the digital/virtual/perceived "weight stack", or digital weight, is moving away from the ground, motor (134) rotates in one direction. If the digital weight is moving towards the ground, motor (134) rotates in the opposite direction. Note that the motor (134) is pulling towards the cable (504) onto the spool. If the cable (504) is unspooling, it is because a user has overpowered the motor (134). Thus, note a distinction between the direction the motor (134) is pulling, and the direction the motor (134) is actually turning.

If the controller circuit (1002, 1004) is set to drive the motor (134) with, for example, a constant torque in the direction that spools the cable, corresponding to the same direction as a weight stack being pulled towards the ground, then this translates to a specific force/tension on the cable (504) and actuator (506). Calling this force "Target Tension", this force may be calculated as a function of torque multiplied by the radius of the spool that the cable (504) is wrapped around, accounting for any additional stages such as gear boxes or belts that may affect the relationship between cable tension and torque. If a user pulls on the actuator (506) with more force than the Target Tension, then that user overcomes the motor (134) and the cable (504) unspools moving towards that user, being the virtual equivalent of the weight stack rising. However, if that user applies less tension than the Target Tension, then the motor (134) overcomes the user and the cable (504) spools onto and moves towards the motor (134), being the virtual equivalent of the weight stack returning.

BLDC Motor. While many motors exist that run in thousands of revolutions per second, an application such as fitness equipment designed for strength training has different requirements and is by comparison a low speed, high torque Thus, a motor with 67.79 Nm of force and a top speed of 395 RPM, coupled to a spool with a 3 inch diameter meets these requirements. 395 RPM is slower than most motors available, and 68 Nm is more torque than most motors on the market as well.

Hub motors are three-phase permanent magnet BLDC direct drive motors in an "out-runner" configuration: throughout this specification out-runner means that the permanent magnets are placed outside the stator rather than inside, as opposed to many motors which have a permanent magnet rotor placed on the inside of the stator as they are designed more for speed than for torque. Out-runners have the magnets on the outside, allowing for a larger magnet and pole count and are designed for torque over speed. Another way to describe an out-runner configuration is when the shaft is fixed and the body of the motor rotates.

Hub motors also tend to be "pancake style". As described herein, pancake motors are higher in diameter and lower in depth than most motors. Pancake style motors are advantageous for a wall mount, subfloor mount, and/or floor mount application where maintaining a low depth is desirable, such as a piece of fitness equipment to be mounted in a consumer's home or in an exercise facility/area. As described herein, a pancake motor is a motor that has a diameter higher than twice its depth. As described herein, a pancake motor is between 15 and 60 centimeters in diameter, for example 22 centimeters in diameter, with a depth between 6 and 15 centimeters, for example a depth of 6.7 centimeters.

Motors may also be "direct drive", meaning that the motor does not incorporate or require a gear box stage. Many motors are inherently high speed low torque but incorporate an internal gearbox to gear down the motor to a lower speed with higher torque and may be called gear motors. Direct drive motors may be explicitly called as such to indicate that they are not gear motors.

If a motor does not exactly meet the requirements illustrated in the table above, the ratio between speed and torque may be adjusted by using gears or belts to adjust. A motor coupled to a 9" sprocket, coupled via a belt to a spool coupled to a 4.5" sprocket doubles the speed and halves the torque of the motor. Alternately, a 2:1 gear ratio may be used to accomplish the same thing. Likewise, the diameter of the spool may be adjusted to accomplish the same.

Alternately, a motor with 100× the speed and 100th the torque may also be used with a 100:1 gearbox. As such a gearbox also multiplies the friction and/or motor inertia by 100×, torque control schemes become challenging to design for fitness equipment/strength training applications. Friction may then dominate what a user experiences. In other applications friction may be present, but is low enough that it is compensated for, but when it becomes dominant, it is difficult to control for. For these reasons, direct control of motor torque is more appropriate for fitness equipment/strength training systems. This would normally lead to the selection of an induction type motor for which direct control of torque is simple. Although BLDC motors are more directly able to control speed and/or motor position rather than torque, torque control of BLDC motors can be made possible with the appropriate methods when used in combination with an appropriate encoder.

Figure 6:
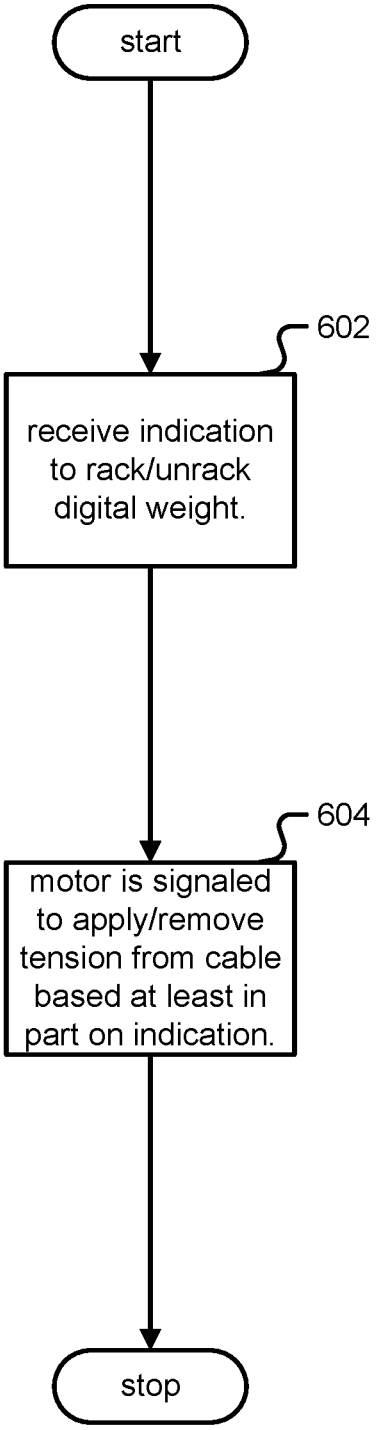
FIG. 6 is a flow chart illustrating an embodiment of a process for digital racking and unracking.

FIG. 6 is a flow chart illustrating an embodiment of a process for digital racking and unracking. In one embodiment, the process of FIG. 6 is carried out by the system of FIG. 5.

In step (602), an indication is received from a user to rack or unrack a digital weight. In one embodiment, the indication is received via proxy, for example from the system itself that may for example detect a dangerous condition, or a remote assistance such as a remote coach.

In step (604) a motor (134) is signaled to apply or remove tension to a cable (504) couple to the motor based at least in part on the indication. The actuator is connected to the cable and is physically arranged to deliver a force to the user. The motor selectively tensions a cable in accordance with an exercise program.

Although the foregoing embodiments have been described in some detail for purposes of clarity of understanding, the invention is not limited to the details provided. There are many alternative ways of implementing the invention. The disclosed embodiments are illustrative and not restrictive.

What is claimed is:

1. An exercise device comprising:

a motor;

a cable coupled to the motor, wherein the motor selectively tensions the cable in accordance with an exercise program; and an actuator connected to the cable, wherein the actuator is physically arranged to deliver a force to a user, wherein the actuator includes a control that signals the motor to apply or remove tension to the cable in response to the user indicating to rack or unrack a digital weight, and wherein at least one of applying or removing tension to the cable is based on one or more of an assessment of the user or a movement to be performed.

2. The exercise device of claim 1, wherein the actuator comprises a smart accessory wirelessly connected to the motor.

3. The exercise device of claim 1, wherein the actuator comprises a Bluetooth smart accessory wirelessly connected to the motor.

4. The exercise device of claim 1, wherein the control is a button.

5. The exercise device of claim 1, further comprising a voice control to rack or unrack the digital weight.

6. The exercise device of claim 1, wherein a nominal tension is applied when the digital weight is unracked.

7. The exercise device of claim 1, wherein unracking the digital weight corresponds to applying tension to the cable.

8. The exercise device of claim 1, wherein in response to an indication to unrack the digital weight, tension is changed first gradually, then more quicky, and then less quickly to reach a desired tension.

9. The exercise device of claim 1, wherein an amount of jerk when the digital weight is unracked is limited.

10. The exercise device of claim 2, wherein a remote coaching unit also sends rack and unrack commands in addition to user generated commands.

11. The exercise device of claim 2, wherein a ramping rate of tension applied is controlled.

12. The exercise device of claim 2, further comprising an audible signal indicating that the digital weight has been unracked.

13. The exercise device of claim 2, further comprising an audible signal indicating that the digital weight has been racked.

14. The exercise device of claim 1, further comprising a haptic cue that the digital weight has been racked.

15. The exercise device of claim 1, further comprising a haptic cue that the digital weight has been unracked.

16. The exercise device of claim 2, wherein when a nonstandard orientation of the actuator is detected, the digital weight is racked in response.

17. The exercise device of claim 1, wherein the actuator comprises a heart rate sensor to detect heart rate.

18. The exercise device of claim 2, wherein the actuator comprises a grip sensor to detect grip.

19. A method, comprising:

receiving an indication from a user to rack or unrack a digital weight; and signaling a motor to apply or remove tension to a cable coupled to the motor based at least in part on the indication to rack or unrack the digital weight;

wherein an actuator is connected to the cable and is physically arranged to deliver a force to the user; and wherein at least one of applying or removing tension to the cable is based on one or more of an assessment of the user or a movement to be performed.

20. The method of claim 19, wherein the actuator comprises a smart accessory wirelessly connected to the motor.

* * * * *